US010577931B2

(12) United States Patent
Sollami

(10) Patent No.: US 10,577,931 B2
(45) **Date of Patent: *Mar. 3, 2020**

(54) BIT HOLDER (PICK) WITH SHORTENED SHANK AND ANGULAR DIFFERENTIAL BETWEEN THE SHANK AND BASE BLOCK BORE

(71) Applicant: The Sollami Company, Herrin, IL (US)

(72) Inventor: Phillip Sollami, Herrin, IL (US)

(73) Assignee: The Sollami Company, Herrin, IL (US)

( * ) Notice: Subject to any disclaimer, the term of this patent is extended or adjusted under 35 U.S.C. 154(b) by 85 days.

This patent is subject to a terminal disclaimer.

(21) Appl. No.: 15/425,086

(22) Filed: Feb. 6, 2017

(65) Prior Publication Data

US 2017/0254200 A1 Sep. 7, 2017

Related U.S. Application Data

(60) Provisional application No. 62/304,169, filed on Mar. 5, 2016.

(51) Int. Cl.

| | |
|---|---|
| ***E21C 35/19*** | (2006.01) |
| ***E21C 35/18*** | (2006.01) |
| ***B28D 1/18*** | (2006.01) |
| *E21C 35/197* | (2006.01) |

(52) U.S. Cl.

CPC ..... *E21C 35/18* (2013.01); *B28D 1/186* (2013.01); *E21C 35/19* (2013.01); *E21C 35/197* (2013.01); *E21C 2035/191* (2013.01)

(58) Field of Classification Search

CPC ... E21C 2035/191; E21C 35/19; E21C 35/197

See application file for complete search history.

(56) References Cited

U.S. PATENT DOCUMENTS

| | | | |
|---|---|---|---|
| 2,382,947 | A | 7/1944 | Brozek |
| 3,342,532 | A | 9/1967 | Krekeler |
| 3,397,012 | A | 8/1968 | Krekeler |
| 3,476,438 | A | 11/1969 | Bower, Jr. |
| 3,519,309 | A | 7/1970 | Engle |
| 3,833,264 | A | 9/1974 | Elders |
| 3,833,265 | A | 9/1974 | Elders |
| 3,865,437 | A | 2/1975 | Crosby |
| 4,084,856 | A | 4/1978 | Emmerich |

(Continued)

FOREIGN PATENT DOCUMENTS

| | | |
|---|---|---|
| DE | 102004049710 | 4/2006 |
| DE | 102011079115 | 1/2013 |

(Continued)

*Primary Examiner* — Janine M Kreck
*Assistant Examiner* — Michael A Goodwin
(74) *Attorney, Agent, or Firm* — Mercedes V. O'Connor; Rockman Videbeck & O'Connor

(57) ABSTRACT

Improvements in previous bit assembly components including shortened slotted shanks and shortened base block bore receiving portions disclose relationships between shank differential interference portions and the corresponding base block bores. Changes in the differences in interference angles lead to changes in slot width, length and steel hardnesses in order to provide necessary retaining forces between the shank and base block bore.

17 Claims, 3 Drawing Sheets

(56) References Cited

U.S. PATENT DOCUMENTS 4,247,150 A 1/1981 Wrulich et al.
RE30,807 E 12/1981 Elders
4,310,939 A 1/1982 Iijima
4,453,775 A 6/1984 Clemmow
4,478,298 A 10/1984 Hake
4,489,986 A 12/1984 Dziak
4,525,178 A 6/1985 Hall
4,561,698 A 12/1985 Beebe
4,570,726 A 2/1986 Hall
4,604,106 A 8/1986 Hall
4,632,463 A 12/1986 Sterwerf, Jr.
4,694,918 A 9/1987 Hall
4,702,525 A 10/1987 Sollami
4,763,956 A 8/1988 Emmerich
4,811,801 A 3/1989 Salesky
4,818,027 A 4/1989 Simon
4,821,819 A 4/1989 Whysong
4,844,550 A 7/1989 Beebe
4,915,455 A 4/1990 O'Niell
4,944,559 A 7/1990 Sionett
5,067,775 A 11/1991 D'Angelo
5,088,797 A 2/1992 O'Neill
5,098,167 A 3/1992 Latham
5,159,233 A 10/1992 Sponseller
5,161,627 A 11/1992 Burkett
5,273,343 A 12/1993 Ojanen
5,287,937 A 2/1994 Sollami
5,302,005 A 4/1994 O'Neill
5,303,984 A 4/1994 Ojanen
5,352,079 A 10/1994 Croskey
5,370,448 A 12/1994 Sterwerf, Jr.
5,374,111 A 12/1994 Den Besten
5,415,462 A 5/1995 Massa
5,417,475 A 5/1995 Graham et al.
5,458,210 A 10/1995 Sollami
5,484,191 A 1/1996 Sollami
5,492,188 A 2/1996 Smith et al.
5,551,760 A 9/1996 Sollami
5,607,206 A 3/1997 Siddle
5,628,549 A 5/1997 Ritchey
5,720,528 A 2/1998 Ritchey
5,725,283 A 3/1998 O'Neill
5,823,632 A 10/1998 Burkett
5,924,501 A 7/1999 Tibbitts
5,931,542 A 8/1999 Britzke
5,934,854 A 8/1999 Krautkremer et al.
5,992,405 A 11/1999 Sollami
D420,013 S 2/2000 Warren
6,019,434 A 2/2000 Emmerich
6,102,486 A 8/2000 Briese
6,176,552 B1 1/2001 Topka, Jr.
6,250,535 B1 6/2001 Sollami
6,331,035 B1 12/2001 Montgomery, Jr.
6,341,823 B1 1/2002 Sollami
6,357,832 B1 3/2002 Sollami
6,371,567 B1 4/2002 Sollami
6,382,733 B1 * 5/2002 Parrott ..... E21C 35/19 299/104
6,428,110 B1 8/2002 Ritchey et al.
6,508,516 B1 1/2003 Kammerer
D471,211 S 3/2003 Sollami
6,585,326 B2 7/2003 Sollami
6,685,273 B1 2/2004 Sollami
6,692,083 B2 2/2004 Latham
D488,170 S 4/2004 Sollami
6,733,087 B2 5/2004 Hall
6,739,327 B2 5/2004 Sollami
6,786,557 B2 9/2004 Montgomery
6,824,225 B2 11/2004 Stiffer
6,846,045 B2 1/2005 Sollami
6,854,810 B2 2/2005 Montgomery
6,866,343 B2 3/2005 Holl et al.
6,968,912 B2 11/2005 Sollami
6,994,404 B1 2/2006 Sollami
7,097,258 B2 8/2006 Sollami
7,118,181 B2 10/2006 Frear
7,150,505 B2 12/2006 Sollami
7,195,321 B1 3/2007 Sollami
7,210,744 B2 5/2007 Montgomery
7,229,136 B2 6/2007 Sollami
7,234,782 B2 6/2007 Stehney
D554,162 S 10/2007 Hall
7,320,505 B1 1/2008 Hall
7,338,135 B1 3/2008 Hall
7,347,292 B1 3/2008 Hall
D566,137 S 4/2008 Hall
7,353,893 B1 4/2008 Hall
7,384,105 B2 6/2008 Hall
7,396,086 B1 6/2008 Hall
7,401,862 B2 7/2008 Holl et al.
7,401,863 B1 7/2008 Hall
7,410,221 B2 8/2008 Hall
7,413,256 B2 8/2008 Hall
7,413,258 B2 8/2008 Hall
7,419,224 B2 9/2008 Hall
7,445,294 B2 11/2008 Hall
D581,952 S 12/2008 Hall
7,464,993 B2 12/2008 Hall
7,469,756 B2 12/2008 Hall
7,469,971 B2 12/2008 Hall
7,469,972 B2 12/2008 Hall
7,475,948 B2 1/2009 Hall
7,523,794 B2 4/2009 Hall
7,568,770 B2 8/2009 Hall
7,569,249 B2 8/2009 Hall
7,571,782 B2 8/2009 Hall
7,575,425 B2 8/2009 Hall
7,588,102 B2 9/2009 Hall
7,594,703 B2 9/2009 Hall
7,600,544 B1 10/2009 Sollami
7,600,823 B2 10/2009 Hall
7,628,233 B1 12/2009 Hall
7,635,168 B2 12/2009 Hall
7,637,574 B2 12/2009 Hall
7,648,210 B2 1/2010 Hall
7,665,552 B2 2/2010 Hall
7,669,938 B2 3/2010 Hall
7,681,338 B2 3/2010 Hall
7,712,693 B2 5/2010 Hall
7,717,365 B2 5/2010 Hall
7,722,127 B2 5/2010 Hall
7,789,468 B2 9/2010 Sollami
7,832,808 B2 11/2010 Hall
7,883,155 B2 2/2011 Sollami
7,950,745 B2 5/2011 Sollami
7,963,617 B2 6/2011 Hall
3,007,049 A1 8/2011 Fader
7,992,944 B2 8/2011 Hall
7,992,945 B2 8/2011 Hall
7,997,660 B2 8/2011 Monyak et al.
7,997,661 B2 8/2011 Hall
8,007,051 B2 8/2011 Hall
8,029,068 B2 10/2011 Hall
8,033,615 B2 10/2011 Hall
8,033,616 B2 10/2011 Hall
8,038,223 B2 10/2011 Hall
8,061,784 B2 11/2011 Hall
8,109,349 B2 2/2012 Hall
8,118,371 B2 2/2012 Hall
8,136,887 B2 3/2012 Hall
8,201,892 B2 6/2012 Hall
8,215,420 B2 7/2012 Hall
8,292,372 B2 10/2012 Hall
8,414,085 B2 4/2013 Hall
8,449,039 B2 5/2013 Hall
8,485,609 B2 7/2013 Hall
8,500,209 B2 8/2013 Hall
8,540,320 B2 9/2013 Sollami
RE44,690 E 1/2014 Sollami
8,622,482 B2 1/2014 Sollami
8,622,483 B2 1/2014 Sollami
8,646,848 B2 2/2014 Hall
8,728,382 B2 5/2014 Hall
9,004,610 B2 4/2015 Erdmann et al.

(56) References Cited

U.S. PATENT DOCUMENTS

| | | | | |
|---|---|---|---|---|
| 9,028,008 | B1 | 5/2015 | Bookhamer | |
| 9,039,099 | B2 | 5/2015 | Sollami | |
| 9,316,061 | B2 | 4/2016 | Hall | |
| 9,879,531 | B2 | 1/2018 | Sollami | |
| 9,909,416 | B1 | 3/2018 | Sollami | |
| 2002/0074850 | A1 | 6/2002 | Montgomery, Jr. | |
| 2002/0074851 | A1 | 6/2002 | Montgomery, Jr. | |
| 2002/0109395 | A1 | 8/2002 | Sollami | |
| 2002/0167216 | A1 | 11/2002 | Sollami | |
| 2002/0192025 | A1 | 12/2002 | Johnson | |
| 2003/0015907 | A1 | 1/2003 | Sollami | |
| 2003/0047985 | A1 | 3/2003 | Stiffler | |
| 2003/0052530 | A1 | 3/2003 | Sollami | |
| 2003/0122414 | A1 | 7/2003 | Sollami | |
| 2003/0209366 | A1 | 11/2003 | McAlvain | |
| 2004/0004389 | A1 | 1/2004 | Latham | |
| 2004/0174065 | A1 | 9/2004 | Sollami | |
| 2005/0212345 | A1 | 9/2005 | Sleep et al. | |
| 2006/0071538 | A1 | 4/2006 | Sollami | |
| 2006/0186724 | A1 | 8/2006 | Stehney | |
| 2006/0261663 | A1 | 11/2006 | Sollami | |
| 2007/0013224 | A1 | 1/2007 | Stehney | |
| 2007/0040442 | A1 | 2/2007 | Weaver | |
| 2007/0052279 | A1 | 3/2007 | Sollami | |
| 2008/0035386 | A1 | 2/2008 | Hall et al. | |
| 2008/0036276 | A1 | 2/2008 | Hall et al. | |
| 2008/0036283 | A1 | 2/2008 | Hall et al. | |
| 2008/0100124 | A1 | 5/2008 | Hall et al. | |
| 2008/0145686 | A1 | 6/2008 | Mirchandani | |
| 2008/0164747 | A1 | 7/2008 | Weaver et al. | |
| 2008/0284234 | A1 | 11/2008 | Hall et al. | |
| 2009/0146491 | A1 | 6/2009 | Fader et al. | |
| 2009/0160238 | A1 | 6/2009 | Hall et al. | |
| 2009/0256413 | A1 | 10/2009 | Majagi | |
| 2009/0261646 | A1 | 10/2009 | Ritchie et al. | |
| 2010/0045094 | A1* | 2/2010 | Sollami | E21C 35/18 299/102 |
| 2010/0244545 | A1 | 9/2010 | Hall | |
| 2010/0253130 | A1 | 10/2010 | Sollami | |
| 2010/0320003 | A1 | 12/2010 | Sollami | |
| 2010/0320829 | A1 | 12/2010 | Sollami | |
| 2011/0006588 | A1 | 1/2011 | Monyak et al. | |
| 2011/0089747 | A1 | 4/2011 | Helsel | |
| 2011/0175430 | A1* | 7/2011 | Heiderich | B23P 11/027 299/105 |
| 2011/0204703 | A1 | 8/2011 | Sollami | |
| 2011/0254350 | A1 | 10/2011 | Hall | |
| 2012/0001475 | A1 | 1/2012 | Dubay et al. | |
| 2012/0027514 | A1 | 2/2012 | Hall | |
| 2012/0056465 | A1 | 3/2012 | Gerer et al. | |
| 2012/0068527 | A1 | 3/2012 | Erdmann | |
| 2012/0104830 | A1 | 5/2012 | Monyak et al. | |
| 2012/0181845 | A1 | 7/2012 | Sollami | |
| 2012/0242136 | A1 | 9/2012 | Ojanen | |
| 2012/0248663 | A1 | 10/2012 | Hall | |
| 2012/0261977 | A1 | 10/2012 | Hall | |
| 2012/0280559 | A1 | 11/2012 | Watson | |
| 2012/0286559 | A1 | 11/2012 | Sollami | |
| 2012/0319454 | A1 | 12/2012 | Swope | |
| 2013/0169023 | A1 | 7/2013 | Monyak | |
| 2013/0181501 | A1 | 7/2013 | Hall et al. | |
| 2013/0199693 | A1 | 8/2013 | Tank et al. | |
| 2013/0307316 | A1 | 11/2013 | Roetsch et al. | |
| 2014/0035346 | A1 | 2/2014 | Fundakowski et al. | |
| 2014/0110991 | A1 | 4/2014 | Sollami | |
| 2014/0232172 | A1* | 8/2014 | Roth | E21C 35/18 299/106 |
| 2014/0262541 | A1 | 9/2014 | Parsana et al. | |
| 2014/0326516 | A1 | 11/2014 | Haugvaldstad | |
| 2015/0028656 | A1 | 1/2015 | Sollami | |
| 2015/0035343 | A1 | 2/2015 | Ojanen | |
| 2015/0198040 | A1 | 7/2015 | Voitic et al. | |
| 2015/0240634 | A1 | 8/2015 | Sollami | |
| 2015/0285074 | A1 | 10/2015 | Sollami | |
| 2015/0292325 | A1 | 10/2015 | Sollami | |
| 2015/0300166 | A1 | 10/2015 | Ries et al. | |
| 2015/0308488 | A1 | 10/2015 | Kahl | |
| 2015/0315910 | A1 | 11/2015 | Sollami | |
| 2015/0354285 | A1 | 12/2015 | Hall | |
| 2016/0102550 | A1 | 4/2016 | Paros et al. | |
| 2016/0194956 | A1 | 7/2016 | Sollami | |
| 2016/0229084 | A1 | 8/2016 | Lehnert | |
| 2016/0237818 | A1* | 8/2016 | Weber | E21C 35/19 |
| 2017/0089198 | A1 | 3/2017 | Sollami | |
| 2017/0101867 | A1 | 4/2017 | Hall et al. | |

FOREIGN PATENT DOCUMENTS

| | | |
|---|---|---|
| DE | 202012100353 | 6/2013 |
| DE | 102015121953 | 7/2016 |
| DE | 102016118658 | 3/2017 |
| EP | 3214261 | 9/2017 |
| GB | 1114156 | 5/1968 |
| GB | 2483157 | 2/2012 |
| GB | 2534370 | 7/2016 |
| WO | 2008105915 A2 | 9/2008 |
| WO | 2008105915 A3 | 9/2008 |
| WO | 2009006612 | 1/2009 |

* cited by examiner

BIT HOLDER (PICK) WITH SHORTENED SHANK AND ANGULAR DIFFERENTIAL BETWEEN THE SHANK AND BASE BLOCK BORE

CROSS-REFERENCE TO RELATED APPLICATION(S)

This application claims priority to U.S. Provisional Application No. 62/304,169, filed Mar. 5, 2016, to the extent allowed by law and the contents of which are incorporated herein by reference in their entireties.

TECHNICAL FIELD

This application relates generally to road milling, mining and trenching equipment and, more particularly, to bit holders or picks having a shortened shank with differential shank/base block bore angles for improved retainability between the two while providing greater access to the rear thereof.

BACKGROUND

Whether milling road surfaces, removing pavement as a first step in replacing same, providing trenching operations or long wall and other mining operations, various combinations of bit assemblies have been utilized to remove material from the terra firma. The end point where material removing equipment contacts the surface of the pavement to be removed is traditionally comprised of a bit assembly that may include bits having a pointed forward end, the bits either mounted on or made an integral part of a bit holder and base blocks in which the base of the bit/bit holder is mounted. The base blocks may be mounted on either an endless chain, a chain/plate system, or a rotatable drum.

Presently, the most common use of such a bit assembly for road milling use is found on a rotatable drum wherein a plurality of such assemblies are mounted, either in V-shape or in spiral form around the outside of the drum. An improvement in such assemblies by applicant is found in U.S. Pat. Nos. 6,371,567, 6,585,326 and RE 44,690, wherein the bit holder or middle piece of the bit assembly is no longer required to be retained on the base block by a threaded shank with a nut therein holding the bit holder on the base block. This improvement by the present applicant included a hollow shank comprising a distal end that is axially slotted, wherein the shank may be driven into a bore in the base block and the distal end of the shank is compressed radially with a sufficient radial force between the bit holder shank and the base block bore to maintain the bit holder mounted on the base block during use.

While such bit assemblies have traditionally been made of a hardened material, such as tungsten carbide, lately, either man-made polycrystalline diamond or industrial diamond material have been utilized to form layers or coatings on tungsten carbide base inserts to provide longer lasting points of contact between the material removing machinery and the pavement, substrate, or other earth material.

These diamond layered or coated bit tip inserts have a substantially longer in-service life for certain pavement removing operations and do not have to be rotatably mounted in a bit holder body in order to provide substantial length of service between replacements. Such material removing end contact products may be termed bits, bit/bit holders, picks, or the like, although all perform the same function of removing material as desired.

When used in road milling or road removal equipment, the bit assemblies are usually positioned in a spiral or V-shape fashion, across a generally cylindrical drum. The spiral or V-shape configuration allows the bit assemblies to be staggered across the drum in closer center-to-center axial bit tip orientation, and allows the loosened material to flow toward the center of the drum to exit the drum housing onto the disposal conveyor. Such heretofore known bit assemblies have included separable bits and bit holders or unitary bit/bit holders with the holder comprising an upper body portion and a hollow slotted shank. The shank has a length approximating 2-½ inches which is compressed radially into a base block bore of similar length. While such staggered V-shape or spiral configurations allow the bit tips to be positioned closer to each other axially along the axis of the drum, the present configuration, with about 2-½ inches long bit holder shanks, crowds the rear access of the holder adjacent the rear of such closely positioned base blocks. This is especially made worse in so-called "double hit" configurations with twice as many rows of such assemblies on each drum.

A need has developed for an improved bit assembly, or parts thereof, that provides greater access to the rear of base blocks for greater ease of removability of bit assemblies therefrom, especially broken assemblies, when such replacement is desired.

SUMMARY

One implementation of the teachings herein is a bit holder comprising a forward body portion and a generally cylindrical hollow shank depending axially from the body portion. The shank includes a slot through a side of the shank, that extends axially inwardly from a distal end of the shank. A fowardmost portion of the shank has an outer diameter larger than the distal end portion of the shank. A bottom of the fowardmost portion is sized to form an annular interference contact.

These and other aspects of the present disclosure are disclosed in the following detailed description of the embodiments, the appended claims and the accompanying figures.

BRIEF DESCRIPTION OF THE DRAWINGS

The various features, advantages, and other uses of the apparatus will become more apparent by referring to the following detailed description and drawings, wherein like reference numerals refer to like parts throughout the several views. It is emphasized that, according to common practice, the various features of the drawings are not to-scale. On the contrary, the dimensions of the various features are arbitrarily expanded or reduced for clarity.

DETAILED DESCRIPTION

Figure 1:
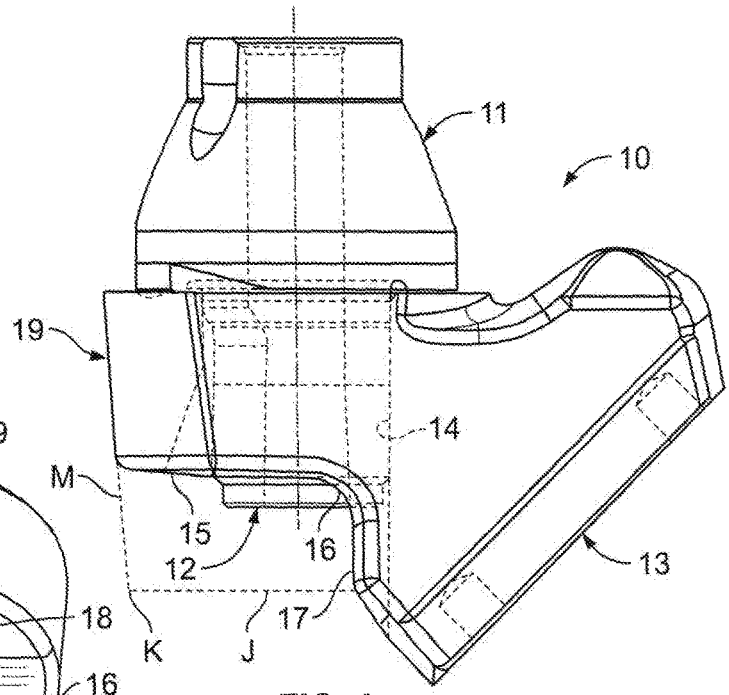
FIG. 1 is a side elevational view of a first embodiment of a bit assembly, without a bit, constructed in accordance with the present disclosure.

Referring to FIG. 1, bit assembly 10 (minus a bit), constructed in accordance with the present disclosure, is used in road milling, mining and trenching. Road milling, mining and trenching equipment have utilized a plurality, sometimes several hundreds, of bit assemblies located in close proximity in staggered positions around a cylindrical drum, mostly in a V-shape or spiral orientation. The closer the bit assemblies are mounted to each other on such a drum, or a long chain, the closer the center-to-center bit tips may be positioned in an axial orientation to provide a smoother surface of earth, minerals, concrete or macadam pavement after material removal.

Prior art road milling bit holder blocks, hereafter termed base blocks, have been designed with bit holder or bit/holder combination receiving bores approximating 2-½ inches in length. This is for a nominal pick or bit holder shank diameter of about 1-½ inches. The shank is also a length necessary to fit in existing base blocks. The closest axial bit tip to bit tip orientation with such earlier design sizes has been about 5/16 inch. But, with extreme crowding of base blocks, a 0.2 inch spacing has been obtained in micro milling machines.

The desire to achieve smoother road milling surfaces required changes to the bit holder and base block geometry previously used on such material removal equipment. Increasing the access to the rear of such bit assemblies when mounted in close approximation to each other decreases the down time necessary when changing bits and bits with broken shanks, bit holders or combination bit/bit holders from such base blocks. FIG. 1 shows a bit holder 11 having a shortened shank 12 as it appears when mounted in a base block 13 having a shortened base block bore 14.

The Base Block

Figure 2:
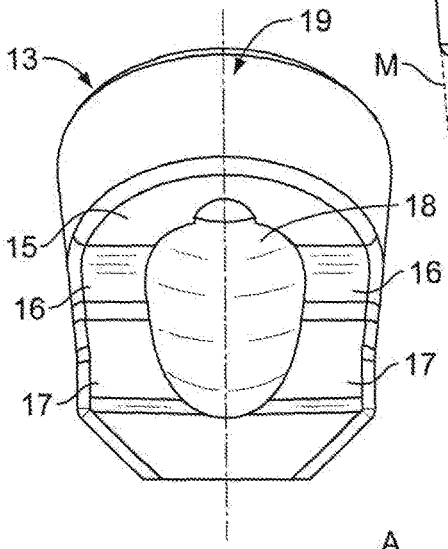
FIG. 2 is a ¾ perspective detail view of the rear of a base block shown in FIG. 1 showing an arcuate partial bit holder bore extension and the opposed strengthening shoulders on either side thereof.

The views of the base block disclosed in FIG. 1 and FIG. 2 show that the metal removed from the back end of the base block 13, which is now denoted by an L-shape bottom of a bit holder mounting portion 19 of the base block, the L-shape bottom defined by side 15 roughly perpendicular to the bore (centerline), curved sides 16-16, and sides 17-17 roughly parallel to the bore centerline. The bottom of the prior bit holder mounting portion was solid metal inside the dotted lines from the bottom of that L shaped cavity extending horizontally at J to an intersection K with a dotted continuation of the predominately vertical line M defining the rearwardmost portion of the former bit holder receiving portion.

This added space J-K-M at the rear of the base block 13 provides substantial added room when mounted on a drum for manual manipulation of tools needed to remove either a broken bit and/or broken bit shank, from the bit holder, or a broken bit holder and/or (unitary bit holder) from the base block 13 which is mounted on a drum or elongate chain (not shown).

Co-Pending Applications

Referring to FIG. 2, the surfaces 15-16-17 defining the outline of the L shape cavity include opposing curved sides 16-16 and rather flat topped sides 17-17 adapted to provide added strength and stress relief adjacent the bottom of the base block bit holder bore 14 and help support the sides of a partial arcuate extension 18 of the base block bit holder bore 14. The arcuate extension 18 of the base block bit holder bore 14 may be an angular continuation or a more interfering angle than the base block bit holder bore 14 located in housing 19.

The use of such shortened base blocks in connection with shortened bit holder shanks are shown in applicant's copending application Ser. No. 14/628,482, filed Feb. 23, 2015, which claims priority of a provisional application, filed Feb. 26, 2014, the contents of which are incorporated herein by reference. The use of various shape bit holders (bit/holders) in combination with such shortened depth base blocks, is disclosed in applicant's provisional application Ser. No. 62/100,764, filed Jan. 7, 2015, the contents of which are incorporated herein by reference.

Figure 6:
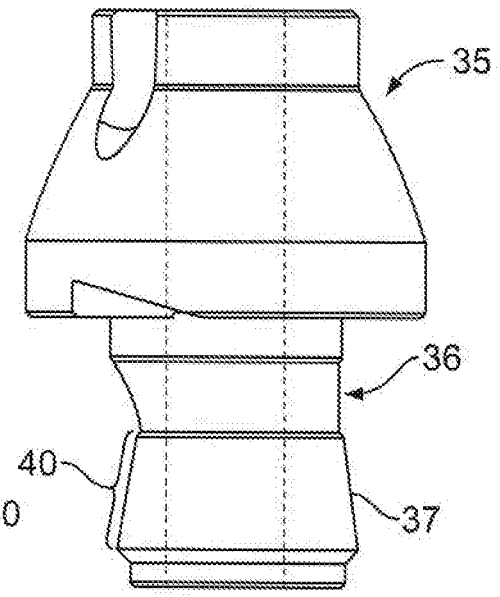
FIG. 6 is a side elevational view of the bit holder shown in FIG. 5.
Figure 7:
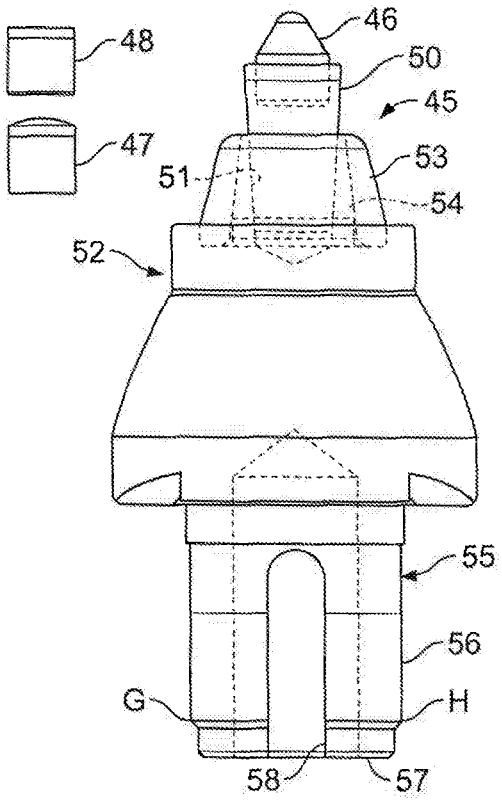
FIG. 7 is a side elevational view of a bit assembly including an integrally formed PCD tip insert on the upper end thereof, and a shortened reverse taper hollow slotted shank constructed in accordance with the present disclosure.
Figure 9:
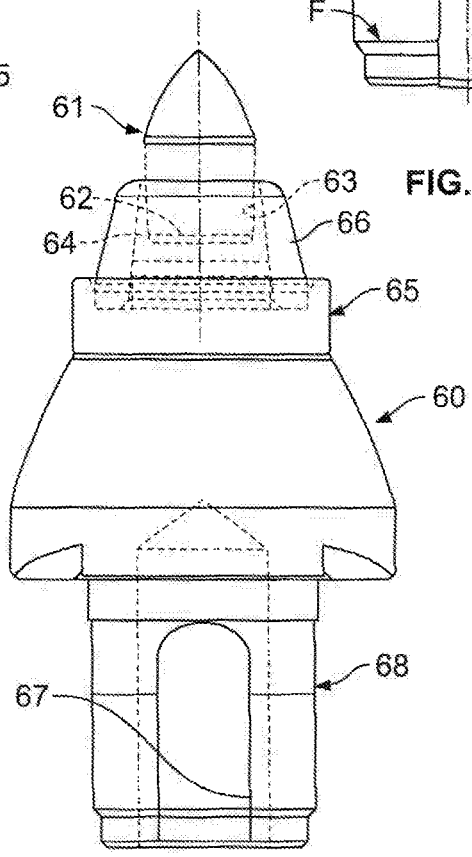
FIG. 9 is a side elevational view of an integrally formed bit/holder combination including an enlarged diameter diamond layer or coated bit tip insert at the upper end of the bit holder body, and a shortened reverse taper shank constructed in accordance with the present disclosure.

As shown in FIGS. 6, 7 and 9, the increased diameters of bit tip inserts, from the 0.565 diameter polycrystalline diamond (PCD) bit tip inserts shown in FIG. 7 to the 0.75 inch diameter bit tip insert shown in FIG. 9, provide for not only increased life of the insert, but also the ability to place the bit tip inserts closer in axial orientation to each other from about 0.6 inch to about 0.2 inch, thus allowing almost micro milling operations to conventional milling operations to utilize the same drums rather than completely different drums.

The increased diameter bit tip inserts are disclosed in applicant's copending U.S. patent application Ser. No. 14/676,364, filed Apr. 1, 2015, which claims priority of U.S. provisional application Ser. No. 61/974,064, filed Apr. 2, 2014, the contents of which are incorporated herein by reference.

The shortening of the bit holder shank 12 necessitated re-engineering of the holding forces between the shank 12 and the base block bit holder bore 14. This change in what may be considered a stronger interference relationship extends not only circumferentially and radially on the bit holder shank, but as shown below also differs along the length of the bit holder shank 12 from that previously used in applicant's initial patents recited above in the BACKGROUND.

Changes in the Shank Profile

Figure 3:
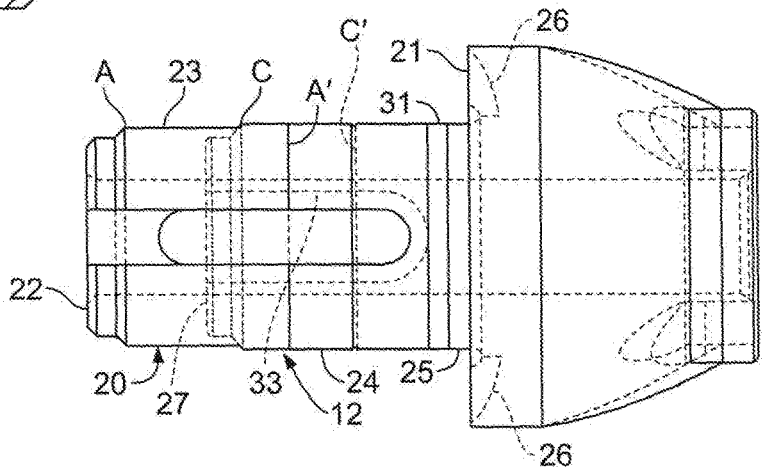
FIG. 3 is an enlarged side elevational view of a presently known bit holder having a shank length of approximately 2-½ inches with a shank diameter of about 1-½ inches, and superimposed thereon in dotted line a side elevational view of a bit holder constructed in accordance with the present disclosure having a shorter shank, about 1-½ inches in effective length, of similar diameter.
Figure 4:
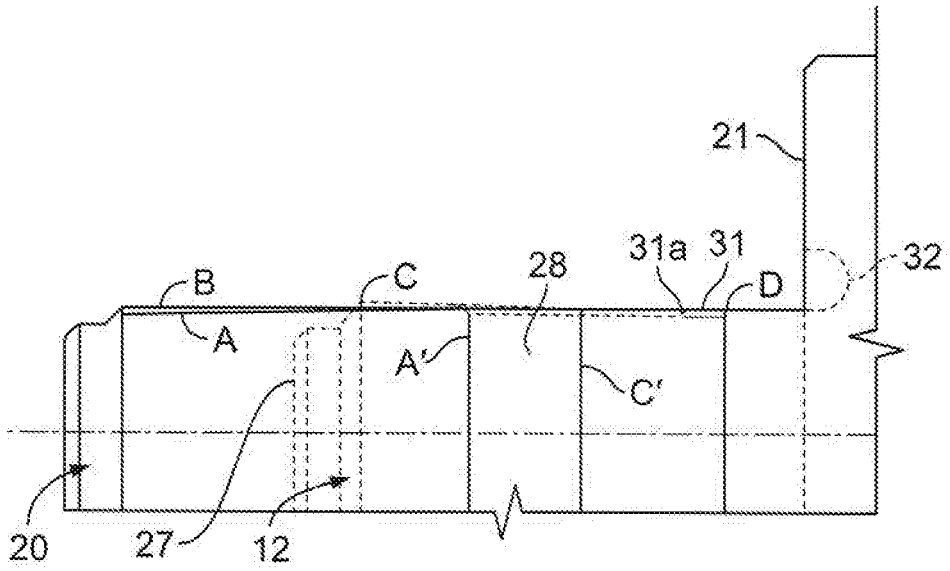
FIG. 4 is a diagrammatic view of the outside surface of the shank of a heretofore known tapered shank, a reverse taper shank of elongate standard length configuration, and in dotted line a shortened reverse taper shank, both of the present disclosure.

Referring to FIGS. 3 and 4, the profile of a traditional length bit holder shank 20 is shown in solid line and improved shortened length bit holder shank 12 is shown in dotted line. Heretofore, bit holder shanks are approximately 2-½ inches from a rear body annular flange 21 to a distal end 22 of the traditional length bit holder shank 20. The heretofore known shank 20 has a tapered interference section 23, adjacent the distal end 22 thereof, that approximates 1-⅛ inches in axial length, a central reduced diameter portion 24, about 1 inch in axial length forward thereof, and another first enlarged diameter portion 25 (not slotted) immediately adjacent the rear body annular flange 21. The annular flange 21 preferably includes a pair of angled undercuts 26-26 for use in extraction of the bit holder 11 (FIG. 1) from the base block 13.

The improved shortened shank 12, shown generally in dotted line in FIG. 3 and in FIG. 4, has immediately adjacent a very distal end 27 (FIG. 4) thereof, about a ¾inch long (C to C1) reverse taper or differential taper portion 28 (FIG. 4), 37 (FIG. 5), a central reduced diameter portion 30 (FIG. 5), and a radially enlarged upper portion 31 (from ⅛ inch to ⅜ inch) in length. With the shank 12 shortened approximately 1 inch in length, as shown in dotted line in FIG. 3 and in solid lines in FIG. 4, the circumferential and radial forces per unit length need to be increased in order to maintain the bit holder shank 12 in the base block bore 14.

As shown most clearly in diagrammatic FIG. 4, the original 2-½ inch length shank taper portion is shown at A to A1. In the first longer shank development, the taper A-A1 is the same taper in the corresponding portion of the heretofore used longer base block bore.

In order to increase the circumferential and radial forces between the former length bit holder shank 20 and the base block bore 14, a taper B with a differential section, shown slightly exaggerated in FIG. 4, increases the interference next to distal end 22 of the shank of the present disclosure from about 0.012 inch, on a nominal 1-½ inch diameter shank that is 2-⅜ inches in length, to about 0.019-0.033 inch, in the shorter shank. The location of the greatest interference differential between the base block bore 14 and the interference portion of the shank 12 is presently found adjacent the letter C as shown in FIG. 4.

With the shortening of the improved shank 12 approximately 1 inch in order to provide additional space, noted in FIG. 1 between the side 15 of the bit holder mounting portion 19 of the base block 13 and the dotted lines J-K-M shown therein, some of the engineering of the longer shank needed to be changed. With the longer shank, there was the ability to drive the shank into the base block with relative ease until about the last half inch of the shank's insertion. The use of identical tapers on the outside of the shank and inside of the base block bore allowed for this ease of insertion.

With a shorter shank 12 and an initial greater interference at the distal end of the shank at taper C-C1, more force is initially needed to insert the shank 12 in the base block bore 14. Without anti-seize material or an oil coating, an axial force of about 2,300 lbs. was found at ¼ inch insertion, about 5,500 lbs. at ½ inch insertion, and about 14,600 lbs. at ¾ inch of complete insertion. It takes about the same number or more hammer hits to drive in the shorter shank of the invention than the longer prior shank.

With the shortening of the shank to that shown in dotted line in FIG. 3 to that shown at C-C1 in FIG. 4, the differential between the tapers in the base block bore 14 and the complimentary section of the shortened shank C-C1 increased from the previously used 0.015 inch on a diameter to approximately 0.022 inch on a diameter on the section of the shank C-C1 in FIG. 4. In the traditional bit holder shank 20 shown in FIG. 4, the greatest radial and circumferential force between the base block bore 14 and the bit holder shank 20 was adjacent the top of the taper A1. By utilizing a differential in the tapers between the base block bore 14 and the portion of the shank designated C-C1 in the shortened shank, the area or band of the greatest force between the shank 12 and the base block bore 14 is moved downwardly from C1 toward the C portion of the shank 12, increasing the interference and providing added radial force per unit length along the shank necessary to retain the shortened shank 12 in the base block bore 14 during use. It should be noted that the so-called "taper" can be a positive one, a negative one, or a zero or cylindrical one within the scope of the present disclosure.

It should also be noted that in addition to the interference adjacent the distal end of the shortened shank, the positioning of the open ended slot and the internal slot as shown in FIG. 3 allowed the interference between the two sections of the shank, which might be called an enhanced interference, to be greater than that found for solid shafts in existing engineering standards books.

A second position of interference is found at the second enlarged upper portion 31 of the shank 12 adjacent the annular flange 21 of the bit holder 11 which is mostly annular in construction and agrees with the interference standards provided for circular solid shafts as found in existing engineering handbooks.

Applicant's development of the base block 13 and bit holder 11, as shown in FIGS. 1-4, the base block bore 14, as shown in FIG. 1, was originally constructed to provide for an annular interference contact between a bottom of the second enlarged upper portion 31 of the bit holder shank 12 and the base block bore 14. This design was developed for several base block bore configurations, one having a tapered upper portion and a cylindrical bottom portion, one having a constant tapered cylindrical bore, and one having an enlarged upper bore segment to more closely resemble the dimensions of the upper shank segment shown at D in FIG. 4.

However, additional research and development has shown that the interference between the base block bore 14 and the bottom of the second enlarged upper portion 31 of the bit holder shank 12 at letter D in FIG. 4, could better be configured so as to produce a ring shape interference at 31*a*, rather than being line contact, with the base block bore 14, preferably having a width or height of about ⅛ to ¼ inch between the bottom of the second enlarged upper portion 31 of the bit holder shank 12 and the upper portion of the base block bore 14. This increased area of annular interference at shoulder 31*a* provides additional circumferential and radial forces between the base block bore 14 and the bit holder shank 12 while still providing an annular space between the very top of the base block bore 14 and the top of the second enlarged upper portion 31 of the bit holder shank 12. The space, together with a semicircular undercut 32 adjacent the annular flange 21 of the bit holder 11 in the upper bit holder body portion, allows for minute movement therebetween to distribute stress loads at that location.

Variations in the Slot

As shown most clearly in FIG. 3, in order to maintain some constants throughout the developmental process, applicant has maintained a wall thickness of the nominal 1-½ inch diameter shank of about ⅜ inch, although slight variations will also work. In order to obtain the added elastic deformation with the added interference of the shortened shank 12, applicant has widened a slot 33 from the distal end 22 of the shank 12 upwardly toward the top of the reduced diameter portion 24 from ⅜ inch to approximately ⅝ inch in width. This ⅝ inch widened slot 33 also provides better access to extract worn bits or broken shanks from the rear of the bit holder 11.

Variations in the length of the slot 33 provide more or less flexibility, with greater length of slot generally providing greater flexibility in engineering the shank/base block bore configuration. Elongating slot 33 in the hollow bit holder shank 12 will result in a slight drooping of the shank 12 on the slot side where metal has been removed, i.e., the axis of the shank 12 is not perfectly aligned with the axis of the base block bore 14. Also, the rear annular flange 21 adjacent the top of the slot may not fully seat against the top of the base block 13. A substantial advantage of using the slotted shank configuration is the lack of the necessity to machine the increased interference portion of the shank after hardening and/or heat treatment. The slot makes up for any distortion or warpage.

Figure 5:
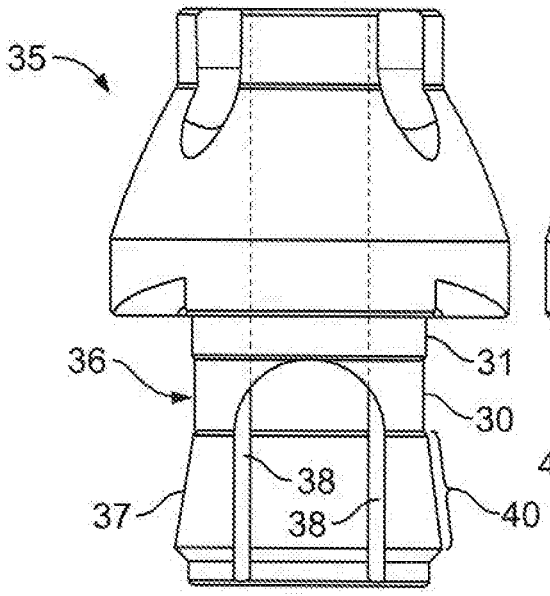
FIG. 5 is a front elevational view of a bit holder having a shortened configuration slotted shank therein with a reverse taper distal end portion shown in exaggerated configuration for emphasis.

As shown most clearly in FIGS. 5 and 6, a second embodiment of the bit holder 35 shows that workable variations in a differential interference portion 37 of a shank 36 can be achieved if the width of a slot 38 is also increased. An axial length 40 of the differential fit portion of the shank 36 as shown in FIGS. 5 and 6 is approximately ¾ inch with the slot 38 being increased from the ⅜ inch width of slot 33 shown in FIG. 3 to about ⅝ inch width of slot 38 shown in FIG. 5.

Unitary Bit-Holder Combinations

Referring to FIGS. 7 and 9, applicant has further developed its bit holders (see paragraphs [0021]-[0023]) into what some describe as picks or combination bit/holders, especially when using diamond or polycrystalline diamond (PCD), layered or coated, bit tip inserts. The PCD bit tip inserts provide such added useful life in some applications that the formerly used rotatable tungsten carbide tipped bits may be incorporated into the unitary and combination bit holders, as the diamond hardness material does not need to be rotatable to provide longer in-use life.

FIG. 7 shows a third embodiment pick or bit holder 45 with one of a plurality of potential diamond coated or PCD layered bit tip inserts having a generally conical top 46, a rounded top 47 or a flat top 48 mounted in a transition member 50 that is anchored in a recess 51 at the top of the bit holder body portion 52, also the subject of U.S. Pat. No. 9,039,099. This transition member 50 is shown in exaggerated reverse taper configuration, although it may be cylindrical or have a slight taper. In this illustrated embodiment, the diamond PCD bit tip insert 46-48 is positioned above the top of the bit holder body portion 52 as the space immediately behind the diamond coated portion of the bit tip insert 46-48 is increased, to accentuate the flow of either concrete, bituminous, or other material around the hardened bit tip insert with less wear at that position and thereby increase the life of the entire assembly.

The transition member 50 may be made of tungsten carbide material, for wear resistance, or various more ductile steel materials in order to provide shock absorbing capability to the top end of the bit/holder. A tungsten carbide annular sleeve 53 surrounds an annular steel flange 54 at the top of the body portion 52 in which the transition member 50 is preferably brazed, interference fitted or shrink fitted.

In the embodiment shown in FIG. 7, a differential taper portion 56 of a shank 55 adjacent a distal end 57 thereof has a differential angle with the adjacent base block bore 14 (as shown in FIG. 1) that is smaller than that shown in FIG. 3, about 0.015 inch on the nominal 1-½ inch shank diameter. The bit holder is preferably made of 4340 steel that has been hardened from RC45-48 to about RC50-55. This also allows for the provision of a slot 58, approximately ⅜ inch in width, that is the same as shown in the longer 2-½ inch long shank 20 shown in FIG. 3. With respect to hardness, a wider slot can be used with a hardness of RC 45-48, and a narrower slot, also with less interference, can be used with a hardness of RC 50-55.

The Fulcrum Effect

Figure 8:
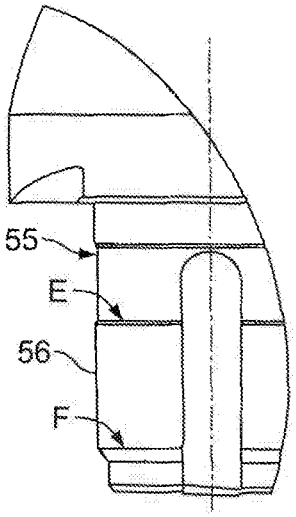
FIG. 8 is a detailed view of the profile of the reverse taper portion of the shortened shank constructed in accordance with the present disclosure.

Referring to FIG. 8, which is a detailed view of the shank 55 shown in FIG. 7, if the majority of the circumferential/radial interference occurs at "E" such as when the same tapers are used on the shank tapered region and on the base block bore 14, greater forces occur at "E," which changes the effective forces along the contacting length. Higher radial stresses are developed at region "E," which is essentially the greatest radial force zone because the forward termination of the slot region acts like a solid, unslotted shank. However, when a reverse taper design is used, such as a taper of about ½ of one degree per side on the shank, and a taper of about one degree per side is used in the base block bore 14, a more uniform loading occurs along the tapered section of the shank at regions F to E. The high force contact zone in region "E" remains the same. However, the circumferential and radial forces at F are nearly equal to or greater than the equivalent forces developed at E. If the same tapers are used on the shank and bore the fulcrum lever arm of the slotted region of the shank exerts the least circumferential and radial forces toward the distal end of the shank at region "F". Hence, in the improvement of the present disclosure, the need to increase the shank to bore interference at the distal end at region "F" of the shank 55 is required to equalize the radial and circumferential forces along the tapered, distal end at region "E" to "F" of the shank 55.

A second lever arm about the slot also exists in a circumferential direction. As shown in FIG. 7, the greatest lever arm effect of the shank 55 exists about 90 degrees around the shank 55 from the slot 58 in both directions, i.e., at G and H. At 180 degrees from the slot 58, the outer diameter of the shank 55 is compressed, similar to that of a solid shaft. A binding action occurs at 180 degrees from the slot 58.

Referring to FIG. 9, a fourth embodiment of the pick or bit holder 60 that includes a larger diameter diamond or PCD coated or carbide layered bit tip insert 61. The bit tip insert 61 approximates ¾ inch in diameter at the bottom of the conical tip portion thereof. A base 62 of the bit tip insert 61 may be cylindrical or slightly tapered and is mounted in a complementary recess 63 in a steel annular flange 64 extending axially upwardly from an upper body portion 65 of the bit holder 60. As with the embodiment shown in FIG. 7, an annular frustoconical member 66 is positioned on the outside of the annular flange 64 and is preferably brazed to the upper body portion 65. The embodiment shown in FIG. 9 is generally 4340 steel having a hardness approximating RC 45-48 and has approximately a ⅜-⅝ inch width slot 67 in a shank 68 of the bit holder 60.

While the present disclosure has been described in connection with certain embodiments, it is to be understood that the invention is not to be limited to the disclosed embodiments but, on the contrary, is intended to cover various modifications and equivalent arrangements included within the scope of the appended claims, which scope is to be accorded the broadest interpretation so as to encompass all such modifications and equivalent structures as is permitted under the law.

What is claimed is:

1. A bit holder adapted to be received in a base block bore, said bit holder comprising a forward body portion;

a generally cylindrical hollow shank depending axially from the body portion and having a slot through a side of the shank, the slot having a slot distal end and a slot forward terminus, the slot extending axially inwardly from a distal end of the shank;

a forwardmost portion of the shank having an outer diameter larger than an adjacent reduced diameter portion more toward the distal end, a bottom of the forwardmost portion being sized to form an annular interference contact; and a lower interference portion of said shank adjacent the distal end of the shank having a taper sized to increase interference with said base block bore as the interference portion extends toward said distal end thereof.

2. The bit holder as defined in claim 1 wherein the slot forward terminus is positioned below said bottom of the forwardmost shank portion.

3. The bit holder as defined in claim 1 wherein the forward body portion has a largest diameter greater than any diameter of the shank.

4. The bit holder as defined in claim 1 wherein the lower interference portion has one of an axial length equal to or less than 1 inch.

5. The bit holder as defined in claim 1 wherein said shank lower interference portion has a nominal ⅞ inch axial length.

6. A combination bit holder and base block comprising:

the base block including a bit holder receiving bore extending therethrough, the bore being cylindrical, tapered, or a combination of a cylindrical bottom portion with a tapered top portion; and the bit holder comprising:

a forward body portion;

a bottom of said body portion engaging a top of said base block when said bit holder is fully, non-rotatably inserted in said base block bore;

a generally cylindrical hollow shank depending axially from the body portion and having a slot through a side of the shank, the slot having a slot distal end and a slot forward terminus, the slot extending axially inwardly from a distal end of the shank; and a lower interference portion of said shank adjacent the distal end of the shank having a taper sized to increase interference with said base block bore as the lower interference portion extends within said base block bore toward said distal end thereof.

7. The combination bit holder and base block as defined in claim 6 wherein said slot forward terminus is positioned below a forwardmost portion of said shank.

8. The combination bit holder and base block as defined in claim 6 wherein the shank is less than 2-⅜ inches in length.

9. The combination bit holder and base block as defined in claim 6 wherein the shank is a nominal 1-½ inches in length.

10. The combination bit holder and base block as defined in claim 6 wherein the forward body portion has a largest diameter greater than a diameter of the shank.

11. The combination bit holder and base block as defined in claim 6 wherein the shank includes a lower reduced diameter portion adjacent a forwardmost portion and said lower interference portion depending from said lower reduced diameter portion.

12. The combination bit holder and base block as defined in claim 6 wherein said base block bore is a nominal 1-½ inches in length.

13. The combination bit holder and base block as defined in claim 6 wherein the base block bore is less than 2-⅜ inches in length.

14. The combination as defined in claim 6 wherein the slot extends through said lower interference portion of the shank adjacent the distal end.

15. A bit holder adapted to be received in a base block bore, said bit holder comprising:

a forward body portion;

a generally cylindrical hollow shank depending axially from the body portion and having a slot through a side of the shank, the slot having a slot distal end and a slot forward terminus, the slot extending axially inwardly from a distal end of the shank, wherein an increase in a width of said slot increases the elastic deformability of the shank;

a forwardmost portion of the shank having an outer diameter larger than an adjacent reduced diameter portion more toward the distal end, a bottom of the forwardmost portion being sized to form an annular interference contact; and a lower interference portion of said shank adjacent the distal end of the shank having a taper sized to increase interference with said base block bore as the interference portion extends toward said distal end thereof.

16. The bit holder as defined in claim 15 wherein an increased length of the slot increases the elastic deformability of the shank and a decreased length of the slot decreases the elastic deformability of the shank.

17. The bit holder as defined in claim 15 wherein said slot in said shank extends through said lower interference portion forwardly adjacent said distal end and includes a terminus above said lower interference portion.

* * * * *